US011313190B2

(12) United States Patent
Krueger et al.

(10) Patent No.: US 11,313,190 B2
(45) Date of Patent: Apr. 26, 2022

(54) ELECTRIC SET TIEBACK ANCHOR VIA PRESSURE CYCLES

(71) Applicants: Matthew Krueger, Spring, TX (US); Robert Pena, Houston, TX (US); Robert Roland, New Orleans, LA (US)

(72) Inventors: Matthew Krueger, Spring, TX (US); Robert Pena, Houston, TX (US); Robert Roland, New Orleans, LA (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/936,339

(22) Filed: Jul. 22, 2020

(65) Prior Publication Data

US 2022/0025725 A1 Jan. 27, 2022

(51) Int. Cl.
*E21B 23/04* (2006.01)
*E21B 23/01* (2006.01)

(52) U.S. Cl.
CPC ..... *E21B 23/0412* (2020.05); *E21B 23/01* (2013.01); *E21B 23/042* (2020.05)

(58) Field of Classification Search
CPC ..... E21B 23/01; E21B 23/0412; E21B 23/042
See application file for complete search history.

(56) References Cited

U.S. PATENT DOCUMENTS

| | | | | |
|---|---|---|---|---|
| 8,881,798 | B2 | 11/2014 | Ramon et al. | |
| 9,982,504 | B2 * | 5/2018 | Yokley | E21B 33/038 |
| 10,060,256 | B2 | 8/2018 | Halfmann et al. | |
| 2009/0272544 | A1 * | 11/2009 | Giroux | E21B 23/00 166/382 |
| 2011/0155379 | A1 * | 6/2011 | Bailey | E21B 7/00 166/324 |
| 2013/0299176 | A1 * | 11/2013 | Yokley | E21B 43/10 166/336 |
| 2014/0151064 | A1 * | 6/2014 | Kalb | E21B 33/1212 166/373 |
| 2018/0094509 | A1 * | 4/2018 | Braddick | E21B 43/106 |
| 2019/0186232 | A1 * | 6/2019 | Ingram | E21B 33/128 |
| 2019/0360288 | A1 * | 11/2019 | Brown | E21B 33/1216 |

* cited by examiner

*Primary Examiner* — Shane Bomar
(74) *Attorney, Agent, or Firm* — Cantor Colburn LLP

(57) ABSTRACT

A tie-back string and a method of coupling the tie-back string to a casing is disclosed. The tie-back string is disposed within the casing. The tie-back string includes an anchor and an actuator section. The actuator section including a sleeve that forms a first chamber and a setting piston that forms a second chamber. A pressure differential is created between the first chamber and the second chamber to move the setting piston to engage the anchor of the tie-back string.

13 Claims, 4 Drawing Sheets

ELECTRIC SET TIEBACK ANCHOR VIA PRESSURE CYCLES

BACKGROUND

In the resource recovery industry, a liner is placed in a wellbore by hanging the liner from a casing using a liner hanger. A tie-back string can be lowered into the wellbore to run between the liner and a wellhead. It can be difficult to provide a tie-back string of a length that will set with the liner without introducing a leak path. Accordingly, there is a desire for improved methods of setting the tie-back string to the liner.

SUMMARY

In one aspect, a method of coupling a tie-back string to a casing is disclosed. The tie-back string is disposed within the casing, the tie-back string including an anchor and an actuator section, the actuator section including a sleeve that forms a first chamber and a setting piston that forms a second chamber. A pressure differential is created between the first chamber and the second chamber to move the setting piston to engage the anchor of the tie-back string.

In another aspect, a tie-back string is disclosed. The tie-back string includes a body, a sleeve on an outer surface of the body that forms a first chamber, and a setting piston on the outer surface of the body that forms a second chamber, wherein a pressure differential created between the first chamber and the second chamber moves the setting piston to engage the tie-back string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
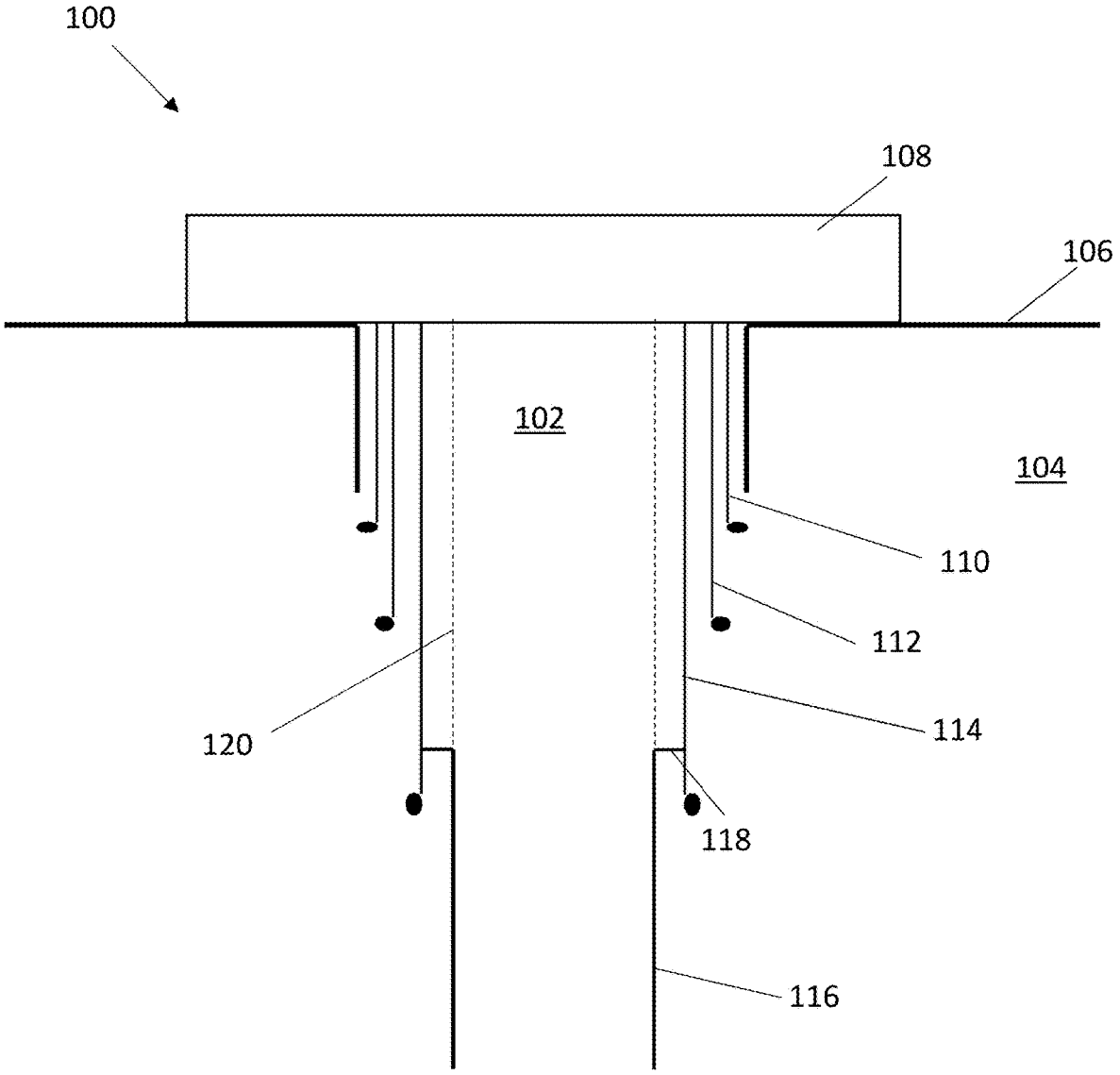
FIG. 1 shows a production casing system within a wellbore formed in a formation, in an illustrative embodiment.

Referring to FIG. 1, a production casing system 100 is shown within a wellbore 102 formed in a formation 104, in an illustrative embodiment. A conductor pipe 110 is placed in the wellbore 102 and extends from the surface 106 to a selected depth. A surface casing 112 is placed in the wellbore 102 within the conductor pipe 110 and extends from the surface 106 to a selected depth below the conductor pipe 110. An intermediate casing 114 is placed in the wellbore 102 within the surface casing 112 and extends form the surface 106 to a selected depth below the surface casing 112.

A liner 116 is deployed within the intermediate casing 114 and hangs from the intermediate casing 114 via a liner hanger 118. A tie-back string 120 can be lowered into the wellbore 102 to run between or extend between a wellhead 108 and the liner hanger 118. The tie-back string 120 is coupled to the liner 116 and is anchored within the intermediate casing 114 using the methods disclosed herein.

Figure 2:
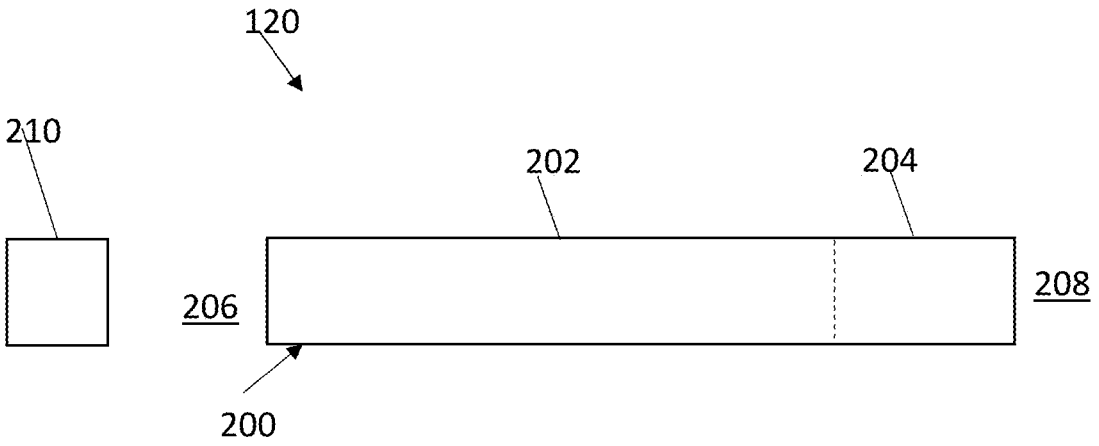
FIG. 2 shows a side view of a tie-back string of the production casing system in an illustrative embodiment.

FIG. 2 shows a side view of the tie-back string 120 in an illustrative embodiment. The tie-back string 120 includes a body 200 that extends from a first end 206 to a second end 208. In various embodiments, the tie-back string 120 can connect to a tie-back casing 210 or other uphole structure at the first end 206 and connect to the liner 116 at the second end 208. The first end 206 has an interface that mates with a corresponding interface of the tie-back casing 210. Similarly, the second end 208 has an interface that mates with a corresponding interface on the liner 116. The body 200 includes an anchor section 202 and an actuator section 204.

Figure 3:
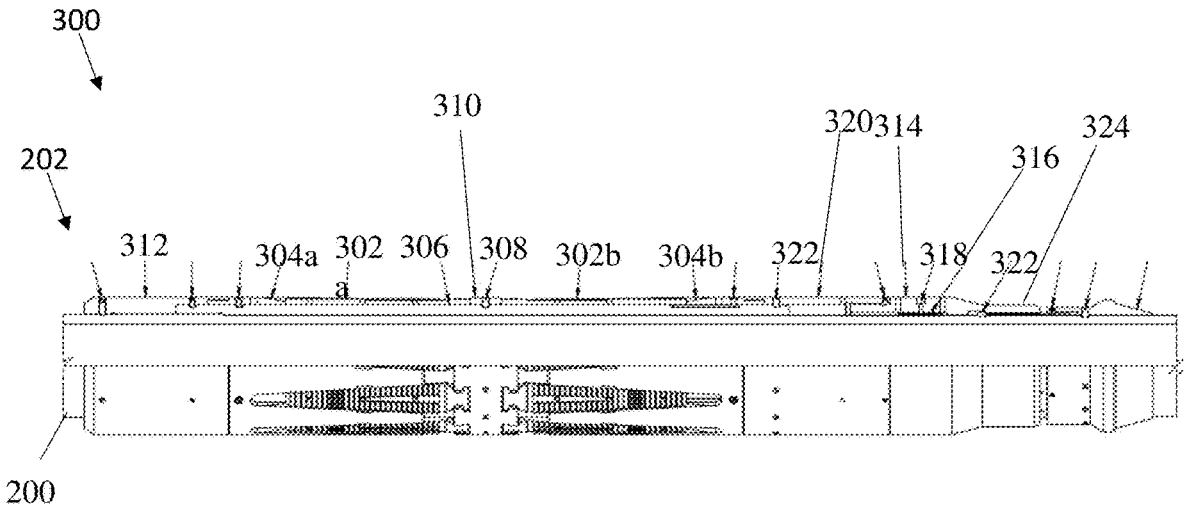
FIG. 3 shows a detailed side view of an anchor section of the tie-back string in an illustrative embodiment.

FIG. 3 shows a detailed side view 300 of the anchor section 202 in an illustrative embodiment. The anchor section 202 includes a first slip 302*a* and a second slip 302*b* disposed between a first wedge 304*a* and a second wedge 304*b*. An internal sleeve 306 is disposed between the body 200 of the tie-back string 120 and an outer layer including the first slip 302*a* and second slip 302*b*. A shear member 308 connects the first slip 302*a* and second slip 302*b* to a T-slot ring 310 at a mid-section between the two wedges 304. An upper gauge ring 312 supports the internal sleeve 306 at a first end. A body lock ring housing 314 supports the internal sleeve 306 at a second end. The body lock ring housing 314 includes a body lock ring 316 and pin 318.

The body lock ring housing 314 can be moved axially along the anchor section 202 to move shear sleeve 320 against second wedge 304*b*. The second wedge 304*b* thereby moves toward first wedge 304*a* to compress the first slip 302*a* and second slip 302*b*, causing first slip 302*a* and second slip 302*b* to expand radially, rupturing the shear member 308 in the process. The body lock ring housing 314 includes a shoulder 324 near the actuator section 204. A collet 322 is disposed within a recess between the shoulder 324 and body 200. The collet 322 moves against the body lock ring housing 314 in response to an actuation stroke from the actuator section 204 to move the body lock ring housing 314, resulting the expansion of first slip 302*a* and second slip 302*b*.

Figure 4:
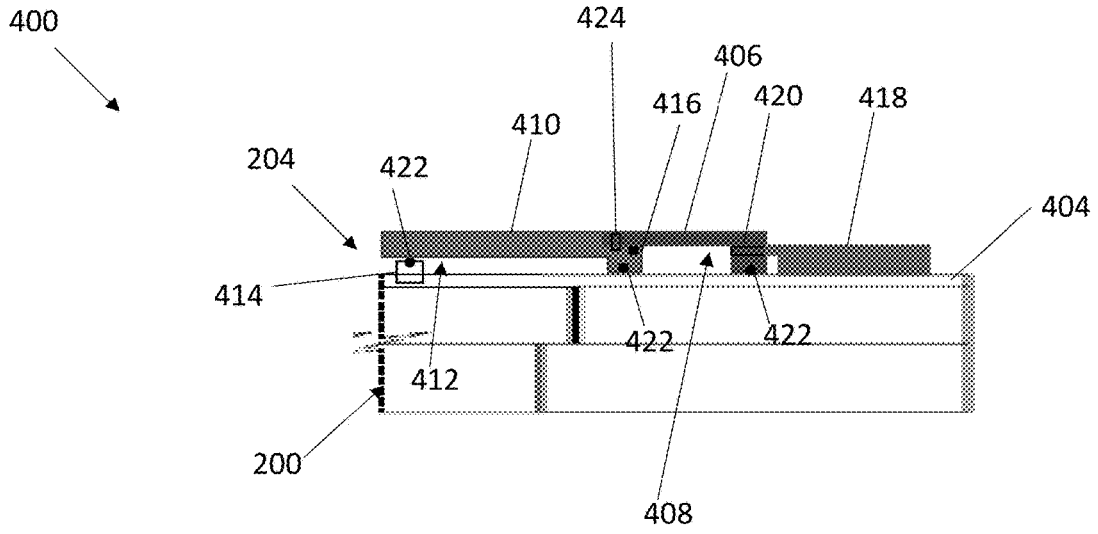
FIG. 4 shows a side view of an actuator section of the tie-back string in an illustrative embodiment.

FIG. 4 shows a side view 400 of the actuator section of the tie-back string 120. A sleeve 406 is disposed on the outer surface 404 of the body 200. An inner diameter of the sleeve 406 is greater than the diameter of the outer surface 404. Thus, the sleeve 406 is spaced apart from the body 200 to form a first chamber 408. A setting piston 410 is disposed on the outer surface 404 of the body 200 next to the sleeve 406 and uphole of the sleeve 406. An inner diameter of the setting piston 410 is greater than the diameter of the outer surface 404. Thus, the setting piston 410 is spaced apart from the body 200 to form a second chamber 412. A seal 414 is connected to or attached to the body 200 and resides between the body 200 and the setting piston 410.

The first chamber 408 and the second chamber 412 have the same pressure or substantially same pressure during a run-in of the tie-back string 120 into the wellbore 102. In various embodiments, a first pressure in the first chamber 408 and a second pressure in the second chamber 412 are at an atmospheric pressure during run-in. The body 200 forms an inner circumferential wall of the first chamber 408 and the sleeve 406 forms an outer circumferential wall and second end wall of the first chamber 408. A bottom end 416 of the setting piston 410 forms a first end wall of the first chamber 408. The volume of the first chamber 408 increases or decreases with an axial position of the setting piston 410.

The setting piston 410 forms an outer circumferential wall and a second end wall of the second chamber 412. The body 200 forms an inner circumferential wall of the second chamber 412. The seal 414 forms a first end wall of the second chamber 412. The volume of the first chamber 408 increases or decreases with an axial position of the setting piston 410.

A control sub 418 disposed on the body 200 adjacent the sleeve 406. The control sub 418 is hydraulically connected to the first chamber 408 via a weep hole 420 in the sleeve 406 passing through the first end wall of the first chamber 408. The control sub 418 includes electronics, such as a circuit board, a transducer and a trigger valve (not shown). The transducer is responsive to a pressure signal in the form of a pressure pulse passing through a wellbore fluid exterior to the body 200. When the pressure in the wellbore fluid is determined to be greater than a selected threshold, the trigger valve can be opened in order to allow wellbore fluid to enter the first chamber 408. As the wellbore fluid enters the first chamber 408, the first pressure within the first chamber 408 increases to a value greater than the second pressure in the second chamber 412. The difference between the first pressure and the second pressure causes the setting piston 410 to move toward the first end 206 of the tie-back string 120. O-rings 422 keep the first chamber 408 and the second chamber 412 sealed as the setting piston 410 moves.

The disclosed method of installing the anchor achieves a pressure integrity between along an annulus exterior to a body of the tie-back string 120. In other words, a first fluid seal is formed between the first end 206 of the tie-back string 120 and the tie-back casing 210 and a second fluid seal is formed between the second end 208 of the tie-back string 120 and the liner 116. Thus, an annular pressure signal can be simply and reliably transmitted to the tie-back string 120. This allows for the pressure signal in the annulus to take the form of a variety of signal patterns.

Figure 5:
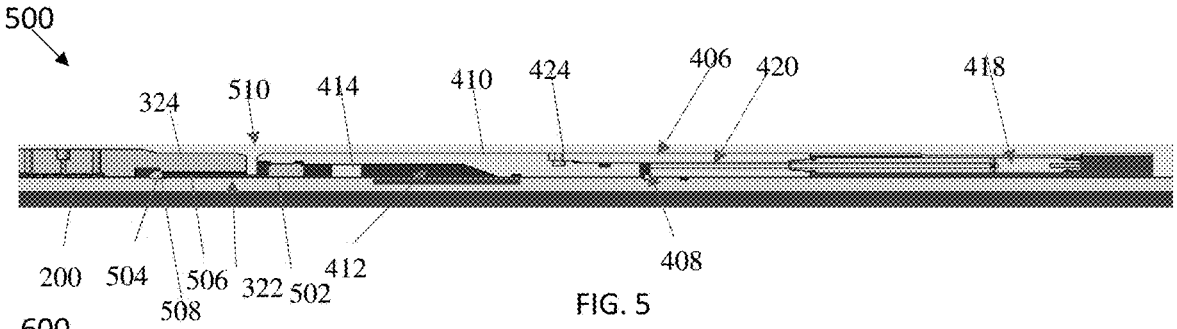
FIG. 5 shows a detailed view of the actuator section in a run-in configuration.

FIG. 5 shows a detailed view 500 of the actuator section 204 in a run-in configuration. The setting piston 410 is secured within a recess of the sleeve 406 via shear member 424 to form the first chamber 408. The second chamber 412 is formed via the setting piston 410 and the seal 414. The setting piston 410 is mechanically coupled to a collet body 502 of the collet 322. The collet 322 includes the collet body 502, a protrusion 504 and an arm 506 extending from the collet body 502 to the protrusion 504. The protrusion 504 resides in a groove 508 formed in the body 200 of the tie-back string 120 when the tie-back string 120 is being run into the wellbore 102. The setting piston 410 is separated from the shoulder 324 of the anchor section 202 by a gap 510.

Figure 6:
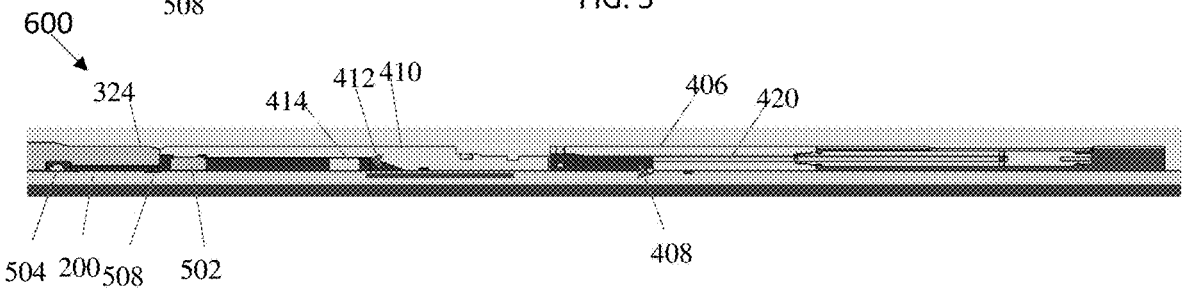
FIG. 6 shows a detailed view of the actuator section in a set configuration.

FIG. 6 shows a detailed view 600 of the actuator section 204 in a set configuration. The setting piston 410 has been forced out of the recess of the sleeve 406 via a pressure differential between the first chamber 408 and the second chamber 412 by pumping fluid into the first chamber 408 through weep hole 420 via control sub 418. The shear member 424 is ruptured in the process. In the set configuration, the setting piston 410 has moved the collet 322 axially, thereby forcing the protrusion 504 out of groove 508. The collet 322 is then moved against shoulder 324, thereby actuating the anchor section 202.

Set forth below are some embodiments of the foregoing disclosure:

Embodiment 1: A method of coupling a tie-back string to a casing. The tie-back string is disposed within the casing, the tie-back string including an anchor and an actuator section, the actuator section including a sleeve that forms a first chamber and a setting piston that forms a second chamber. A pressure differential is created between the first chamber and the second chamber to move the setting piston to engage the anchor of the tie-back string.

Embodiment 2: The method of any prior embodiment, wherein the setting piston is configured to form a wall of the first chamber, further comprising creating the pressure differential to expand the first chamber to move the setting piston.

Embodiment 3: The method of any prior embodiment, further comprising controlling a first pressure within the first chamber via a control sub.

Embodiment 4: The method of any prior embodiment, wherein the sleeve further comprises a weep hole, further comprising introducing a fluid into the first chamber via the weep hole to create the pressure differential.

Embodiment 5: The method of any prior embodiment, further comprising creating the pressure differential in response to a pressure signal propagated through a fluid external to a body of the tie-back string.

Embodiment 6: The method of any prior embodiment, wherein the actuator section further comprises a seal attached to a body of the tie-back string to form the second chamber with the setting piston, wherein moving the setting piston with respect to the seal increases a pressure within the second chamber.

Embodiment 7: The method of any prior embodiment, further comprising running the tie-back string into a wellbore with the first chamber and the second chamber at an atmospheric pressure.

Embodiment 8: The method of any prior embodiment, further comprising moving the setting piston to move a collet that couples the setting piston to the anchor.

Embodiment 9: A tie-back string. The tie-back string includes a body, a sleeve on an outer surface of the body that forms a first chamber, and a setting piston on the outer surface of the body that forms a second chamber, wherein a pressure differential created between the first chamber and the second chamber moves the setting piston to engage the tie-back string.

Embodiment 10: The tie-back string of any prior embodiment, wherein the setting piston is configured to form a wall of the first chamber.

Embodiment 11: The tie-back string of any prior embodiment, further comprising a control sub configured to control a first pressure within the first chamber.

Embodiment 12: The tie-back string of any prior embodiment, wherein the sleeve further comprises a weep hole and the control sub is configured to control the first pressure within the first chamber by introducing a fluid into the first chamber via the weep hole.

Embodiment 13: The tie-back string of any prior embodiment, wherein the control sub is configured to create the pressure differential in response to a pressure signal propagated through a fluid external to the body.

Embodiment 14: The tie-back string of any prior embodiment, further comprising a seal that forms the second chamber with the setting piston, the seal attached to the body.

Embodiment 15: The tie-back string of any prior embodiment, wherein the first chamber and the second chamber are at atmospheric pressure during run-in of the tie-back string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of coupling a tie-back string to a casing, comprising:

disposing the tie-back string within the casing, the tie-back string including an anchor and an actuator section, the actuator section including a sleeve that forms a first chamber and a setting piston that forms a second chamber; and creating a pressure differential between the first chamber and the second chamber in response to a pressure signal propagated through a fluid external to a body of the tie-back string, the pressure differential moving the setting piston to engage the anchor of the tie-back string.

2. The method of claim 1, wherein the setting piston is configured to form a wall of the first chamber, further comprising creating the pressure differential to expand the first chamber to move the setting piston.

3. The method of claim 1, further comprising controlling a first pressure within the first chamber via a control sub.

4. The method of claim 3, wherein the sleeve further comprises a weep hole, further comprising introducing a fluid into the first chamber via the weep hole to create the pressure differential.

5. The method of claim 1, wherein the actuator section further comprises a seal attached to a body of the tie-back string to form the second chamber with the setting piston, wherein moving the setting piston with respect to the seal increases a pressure within the second chamber.

6. The method of claim 1, further comprising running the tie-back string into a wellbore with the first chamber and the second chamber at an atmospheric pressure.

7. The method of claim 1, further comprising moving the setting piston to move a collet that couples the setting piston to the anchor.

8. A tie-back string, comprising:

a body;

a sleeve on an outer surface of the body that forms a first chamber; and a setting piston on the outer surface of the body that forms a second chamber, wherein a pressure differential created between the first chamber and the second chamber moves the setting piston to engage the tie-back string; and a control sub configured to create the pressure differential in response to a pressure signal propagated through a fluid external to the body.

9. The tie-back string of claim 8, wherein the setting piston is configured to form a wall of the first chamber.

10. The tie-back string of claim 8, wherein the control sub is configured to control a first pressure within the first chamber.

11. The tie-back string of claim 10, wherein the sleeve further comprises a weep hole and the control sub is configured to control the first pressure within the first chamber by introducing a fluid into the first chamber via the weep hole.

12. The tie-back string of claim 8, further comprising a seal that forms the second chamber with the setting piston, the seal attached to the body.

13. The tie-back string of claim 8, wherein the first chamber and the second chamber are at atmospheric pressure during run-in of the tie-back string.

* * * * *